United States Patent [19]

Yamamoto

[11] Patent Number: 4,459,903

[45] Date of Patent: Jul. 17, 1984

[54] VERTICAL ABRASIVE ROLL RICE POLISHING MACHINE

[76] Inventor: Soichi Yamamoto, 813 - 17 Oazo Tendou Kou, Tendou-Shi, Yamagata-Ken, Japan

[21] Appl. No.: 375,443

[22] Filed: May 6, 1982

[30] Foreign Application Priority Data

Jun. 19, 1981 [JP] Japan ..... 56-95590

[51] Int. Cl.[3] ..... B02B 3/00; B02B 7/02

[52] U.S. Cl. ..... 99/519; 99/524; 99/528; 99/605; 99/611; 99/618; 241/73; 241/239; 426/482

[58] Field of Search ..... 99/518, 519, 523, 524, 99/568, 571, 574–576, 579, 580, 581, 582, 600–602, 605–608, 609–611, 617–622, 528; 241/244–246, 73, 7, 239; 130/27 M, 30 E; 426/481, 482

[56] References Cited

U.S. PATENT DOCUMENTS 262,504 8/1882 Teter ..... 426/482

655,805 8/1900 Shellabarger ..... 99/617 X 1,424,638 8/1922 Giozza ..... 99/609

3,734,752 5/1973 Hendley ..... 426/481

FOREIGN PATENT DOCUMENTS 2640870 9/1975 Fed. Rep. of Germany ..... 99/608

*Primary Examiner*—Timothy F. Simone

*Attorney, Agent, or Firm*—Shlesinger, Fitzsimmons & Shlesinger

[57] ABSTRACT

An abrasive roll rice polishing machine which comprises a vertical framework assembly, a vertical rotary shaft extending in the vertical axis of the framework assembly and journalled therein, an abrasive roll mounted on the shaft for rotation therewith, a vertically movable polishing cylinder provided within the framework assembly surrounding the abrasive roll in peripherally spaced relationship to the latter to define a polishing chamber therebetween, a hopper at the top of the framework assembly and a discharge port at the bottom of the polishing chamber.

5 Claims, 12 Drawing Figures

VERTICAL ABRASIVE ROLL RICE POLISHING MACHINE

BACKGROUND OF THE INVENTION

This invention relates to an abrasive roll rice polishing machine and more particularly, to an abrasive roll rice polishing machine in which load applied to the polishing chamber can be automatically adjusted to thereby polish hulled rice grains with theoretical uniformity.

As compared with a horizontal adrasive roll rice polishing machine, although a vertical abrasive roll rice polishing machine has the advantages that hulled rice grains can be polished while maintaining their original configuration and that the rate of generation of crushed rice grains is lower, since the vertical abrasive roll rice polishing machine is a rice polishing machine in which substantially no pressure (load applied to the polishing chamber) is applied, the vertical abrasive roll rice polishing machine has the drawback that the machine has a substantially lower polishing efficiency (the polishing efficiency is on the order of one fifth that of the horizontal abrasive roll rice polishing machine).

The rice polishing machine illustrated in FIG. 1 is a prior art horizontal abrasive roll rice polishing machine in which a rice grain feed screw B and an abrasive roll C are coaxially mounted on a common horizontal shaft A, the screw, roll and shaft are surrounded by a horizontal rice grain feed cylinder D', the raw material or hulled rice grains are fed into the feed cylinder D' at a supply port E provided in the top of the cylinder D', a discharge port F is provided in a lower portion of the end wall of the feed cylinder D' opposite from the end wall thereof adjacent the supply port E and a resistance cover G is pivoted to the discharge port F. In operation, the horizontal shaft A is rotated and hulled rice grains are supplied into the feed cylinder D' through the supply port E and then fed horizontally onto the periphery of the abrasive roll C under a high pressure provided by the screw B to be polished by the roll. The rice grain polishing operation is carried out with the closed resistance cover G providing a high pressure to resist the discharge of the rice grains under pressure through the discharge port. Thus, although the horizontal abrasive roll rice polishing machine has the advantage that hulled rice grains are rapidly polished, as mentioned hereinabove, since the rice grain polishing operation in the machine is a forced polishing, the machine has the drawback that a substantial amount of crushed rice grains are generated therein. In addition, since the polishing machine is of horizontal type, some of the rice grains accumulate in a relatively thicker layer by their gravity in the lower portion of the polishing chamber and the rest are distributed in a relatively thinner layer in the upper portion of the polishing chamber resulting in uneven polishing.

The rice polishing machine illustrated in FIG. 2 is a prior art vertical abrasive roll rice polishing machine commonly operated in "sake" breweries. In FIG. 2, reference character H denotes a vertical rotary shaft and reference character I denotes an abrasive roll mounted on an upper portion of the vertical shaft H for rotation therewith. The upper end of the vertical shaft H terminates short of the top of the abrasive roll I whereas the lower end of the shaft extends beyond the bottom of the roll. A pulley and a belt (not shown) are mounted on the vertical shaft below the abrasive roll I to drive the shaft from a suitable drive source (not shown). In the rice polishing mashine of FIG. 2, hulled rice grains a are fed into the polishing chamber M via the supply port J and polished by the adrasive roll I (emery stone) rotating in a horizontal plane while being stirred up thereby. The polished rice grains are then discharged out of the polishing chamber M via the discharge Port K provided in a lower portion of the chamber. However, the polishing machine has the drawback that since the discharge port K is not positioned below the polishing chamber M in coaxial with the vertical axis of the chamber, but in the side wall of the polishing chamber the rice grains accumulating at the area shown by the arrow L can not be easily discharged through the discharge port. That is, since the lower end of the vertical shaft H extends beyond the bottom of the abrasive roll I, the discharge port K can not be provided at locations other than the side wall of the polishing chamber M. Of course, since the abrasive roll I is rotating at a substantially high periphral speed as high 2000 fpm, although the rice grains a accumulating at the area shown by the arrow L are discharged through the discharge port K under centrifugal force while being stirred up in a horizontal plane by the rotating abrasive roll I, even a slight increase in the resistance provided by the resistance cover G pivoted to the discharge Port K as shown in FIG. 2 causes the clogging up of polishing chamber M with the rice grains and the abrasive roll I ceases its rotation instantly resulting in any trouble in the machine. That is, the resistance cover G is a pretended resistance device which is used in a non-resistance condition under which the resistance cover offer substantially no reistance to the discharge of polished rice grains. Thus, the machine is an inefficient rice polishing mabhine. In the foregoing, it has been described that the discharge port K has to be provided in the side wall of the polishing chamber M because of the presence of the rotary shaft H in the vertical axis of the polishing chamber, the rice polishing machine as shown in FIG. 3 is improved over the rice polishing machine of FIG. 2 with respect to the location of the discharge port.

Referring to FIG. 3 in which a prior art vertical abrasive roll rice polishing machine is illustrated, the lower end of the vertical rotary shaft H does not extend beyond the bottom of the abrasive roll I whereas the upper end of the shaft H extends beyond the top of the abrasive roll. A pulley N is mounted at the extended upper end of the vertical shaft H and thus, the shaft amd the abrasive roll mounted thereon are driven by the upper end of the shaft from an external drive source (not shown). With the arrangement of the rice polishing machine of FIG. 3, the discharge port K can be positioned at the bottom of the polishing chamber M in the vertical axis of the shaft below the abrasive roll I to thereby eliminat:e the accumulation of rice grains at the area shown by the arrow L as experienced in the rice polishing machine of FIG. 2. However, since the pully N is positioned right below the material supply port J, the supply of hulled rice grains is not easy. In the rice polishing machine of FIG. 3, although the pulley N is provided with through openings (not shown) through which the hulled rice grains are supplied into the polishing chamber M via the supply port J, since the shaft H and accordingly, the pulley N mounted thereon rotates at a substantially high speed, smooth flow of the hulled rice grains through the openings in the pulley N is not attained. Thus, the polishing chamber M is formed with an opening P in the side wall thereof eccentric to the vertical axis of the chamber for supplying hulled rice grains into the polishing chamber through the opening P whereby the hulled rice grains are supplied into the polishing chamber eccentric to the vertical axis of the chamber. Thus, the rice polishing machine of FIG. 3 is unreasonable with respect to the supply of hulled rice grains.

SUMMARY OF THE INVENTION

Therefore, the present invention is to provide a novel and improved abrasive roll rice polishing machine which can effectively eliminate the drawbacks inherent in the prior art abrasive roll rice polishing machines referred to hereinabove.

The purpose of the present invention is to provide an abrasive roll rice polishing machine which is improved over the prior art abrasive roll rice polishing machines.

The above and other objects and attendant advantages of the present invention will be more readily apparent to those skilled in the art from a reading of the following detailed descrption in conjunction with the accompanying drawings which show prior art rice polishing machines and a preferred embodiment of the rice polishing machine constructed in accordance with the principle of the present invention for illustration purpose only, but not for limiting the scope of the invention thereto in any way.

BRIED DESCRIPTION OF THE DRAWINGS

and

Figure 12:
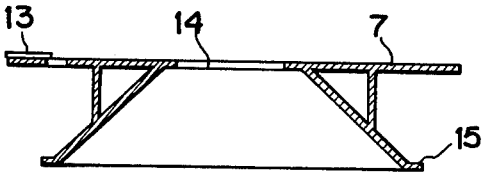

FIG. 12 is a fragmentary cross-sectional view of the downwardly flared edge of the supply port in said embodiment of the rice polishing machine.

Preferred Embodiment of the Invention

Figure 4:
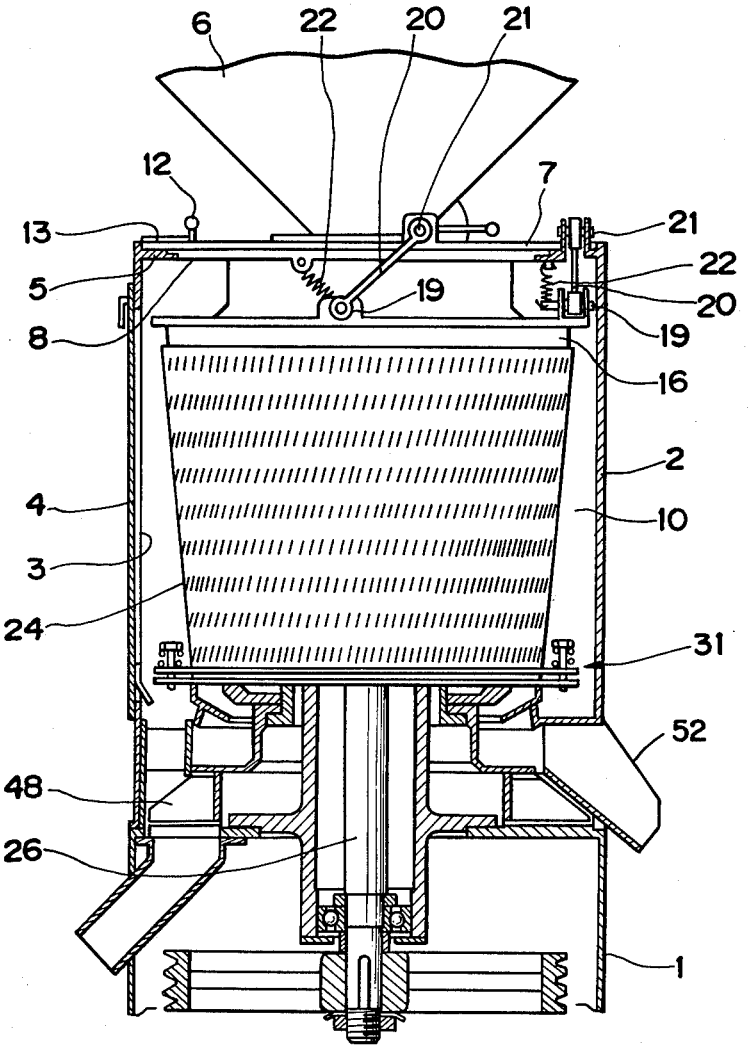
FIG. 4 is an elevational view in partial section of one preferred embodiment of the vertical abrasive roll rice polishing machine embodying the present invention.
Figure 5:
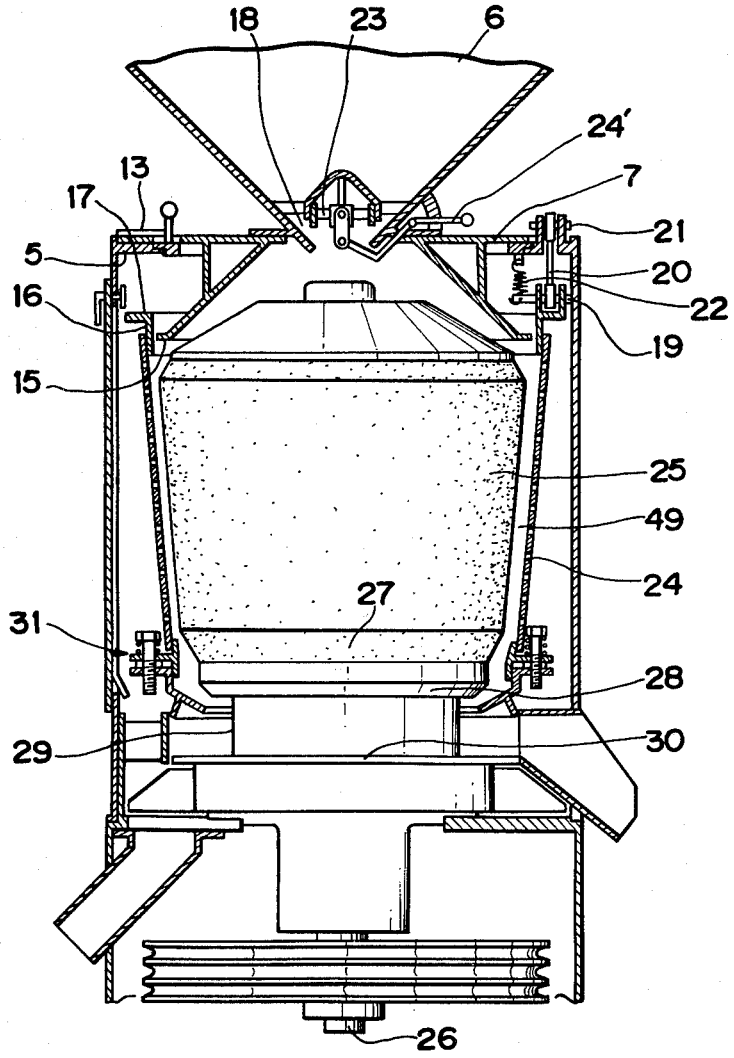
FIG. 5 is similar to FIG. 4, but shows the polishing chamber and hopper of said rice polishing machine in section.
Figure 6:
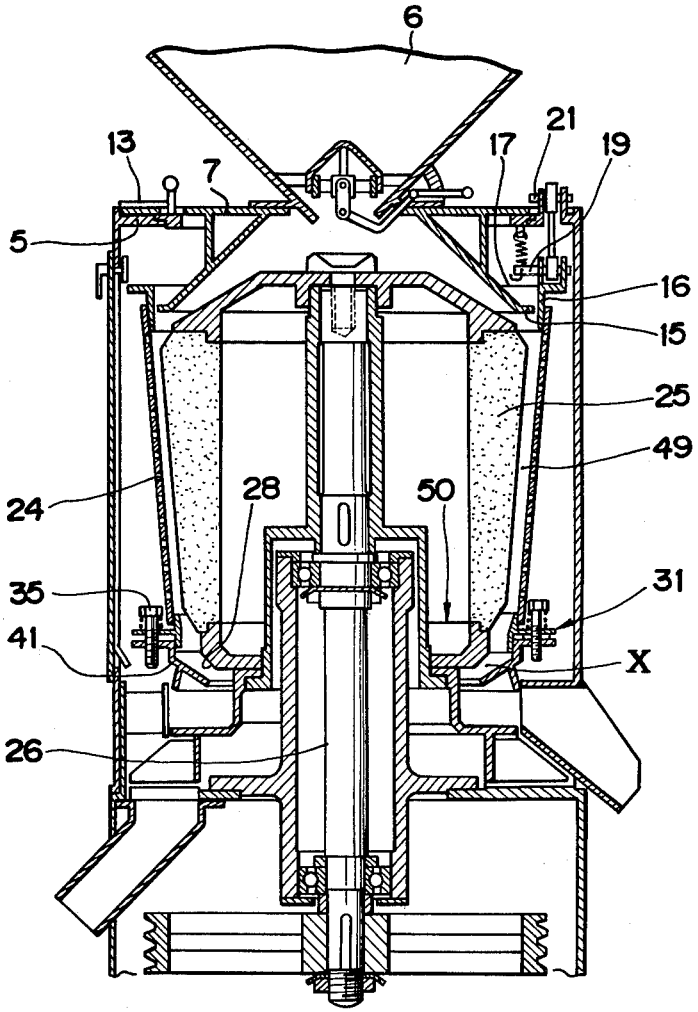
FIG. 6 is a vertically sectional view of the entire rice polishing machine as shown in FIGS. 4 and 5.

The present invention will be now described referring to FIGS. 4 through 12 of the accompanying drawings in which one preferred embodiment of the vertical abrasive roll rice polishing machine embodying the present invention is illustrated. In FIG. 4, feference numeral 1 denotes a lower framework on and to which an upper framework 2 is mounted and suitably secured. The upper framework 2 is in the from of a vertically extending hollow cylinder having a circular or square cross-section configuration as seen in the horizon. The peripheral side wall of the upper framework 2 is formed with a plurality of spaced window openings 3 which are adapted to be opened and closed by covers 4 detachably secured to the peripheral side wall of the upper framework 2. Attached to the inner surface of the upper framework 2 at the upper end or the top thereof is an annular stepped flange 5 on the upper surface of which the mount 7 for a hopper 6 is fixedly mounted. The hopper mount 7 is formed by a horizontal plate which has a configuration substantually corresponding to that of the hollow interior of the cylindrical upper framework 2. In addition to the above-mentioned hopper mount 7, the stepped flange 5 has a spring bearing ring 8 fitted therein and secured thereto. The peripheral edge 9 (see FIG. 11) of the spring bearing ring 8 rides on the annular shoulder 5' (see FIG. 10) on the inner surface of the flange 5 and spaced spring receiving projections or ears 11 extend downwardly from the undersurface of the ring 8. Reference numeral 12 denotes a manual lever secured at one or the lower end to the spring bearing ring 8 and by manually rotating the manual lever 12 in a horizontal pane, the ring 8 is rotated in a horizontal plane. Reference numeral 13 denotes a stop provided on the hopper mount 7 for engaging the lever 12 to arrest the rotational movement of the lever 12 when the lever has rotated to a predetermined position in its horizontal rotational movement. The mount 7 on which the hopper 6 is mounted is formed with an opening 14 in the center thereof (see FIG. 12) which serves as the material supply port and through which the material or hulled rice grains from the hopper 6 are fed to the polishing chamber defined within the upper framework 2 as will be described hereinafter. The material supply port 14 has a truly circular cross-section as seen in the horizontal and flares downwardly terminating at the largest diameter lower edge 15 (see FIG. 12). Reference numeral 16 denotes a vertically slidable cylinder (or the upper member of a vertically movable polishing cylinder ) having the upper end 17 which loosely surrounds the lower edge 15 of the supply port 14. The vertical movement distance of the slidable cylinder 16 is so limited that even when the cylinder moves to the predetermined lowermost end of the vertical movent the upper end 17 of the cylinder will not be positioned below the plane of the lower edge 15 of the supply port 14. The vertically slidable cylinder 16 has a truly circular cross-section as seen in the horizontal with a uniform diameter throughout the length thereof. Secured to the upper surface of the annular upper end flange 17 of the slidable cylinder 16 are spaced ears 19 and also secured to the top of the upper framework 2 in positions above and offset with respect to the respectively adjacent ears 19 are ears 21. An inclined rod 20 extends between and is secured at the opoosite ends to the associated upper and lower ears 21, 19, respectively. An inclined spring 22 extends between and is anchored at the opposite ends to the lower end of the associated rod 20 and each of the projections 11 on the spring bearing ring 8. The inclination direction of the inclined springs 22 is opposite to that of the associated inclined rods 20. As more clearly shown in FIG. 4, when the manual lever 12 is rotated in a horizontal plane to rotate the spring bearing ring 8 in the direction to extend the inclined springs 22, 22, the tension on the springs 22 is increased. Suitably mounted within the hopper 6 is a regulator valve 23 which is adapted to adjust the opening of the material supply passage 18 defined at the bottom of the hopper 6. The regulator valve 23 has the inner end of a lever 24' pivoted thereto by means of a pivot pin and thus, when the lever 24' is moved downwardly and upwardly to lower and raise the valve 23, the opening of the passage 28 is contracted and expanded. The lower end of the slidable cylinder 16 has the upper end of a vertically movable polishing cylinder 24 secured thereto and the lower end of the polishing cylinder is suitbaly secured to the lower end of the upper framework 2. The polishing cylinder 24 is formed of a plurality of perforated plates stamped out of a sheet metal. An abrasive roll 25 is mounted within the polishing cylinder 24 and connected to the upper end of a vertical rotary shaft 26 for rotation therewith. The lower end of the vertical rotary shaft 26 is operatively connected to a drive source (not shown) through a pulley-belt transmission, for example. The outer periphery of the abrasive roll 25 has an inverted frusto-conical configuration. When the abrasive roll 25 is in the form of a blast roll (a hollow perforated roll from which air is blown), the rotary shaft 26 is formed of a hollow tubular member, such as disclosed, for example, in my copending U.S. application Ser. No. 376,281, filed May 6, 1982. The lower end of the abrasive roll 25 is formed with a shoulder 27 which reduces its diameter sharply towards the extreme lower end and a dish-shaped metal member 50 (see FIG. 6) is fitted about the lower portion of the shoulder 27. The lower edge of the periphery of the dish-shaped member 50 tapers downwardly at 28. The shoulder 27 is formed as a part of the abrasive roll 24 whereas the tapered lower edge 28 is formed as a part of the metal member 50. A vertical cylinder 29 having the diameter substantially smaller than that of the dish-shaped metal member 50 is attached at the upper end to the tapered lower edge 28 of the dish-shaped member 50. The lower end of the vertical cylinder 29 is formed with a flange 30 which serves as a guide face. Secured to the lower end of the polishing cylinder 24 is a lower frame 31 which has a T-shaped cross-section as seen in a horizontallying-sideways plane and includes a vertical or head portion 32 and a horizontal or leg portion 33. The horizontal or leg portion 33 is formed with three or four vertical through holes 34 in circumferentially equally spaced relationship for loosely receiving vertical adjusting bolts 35, only two of which are shown in the drawing. The adjusting bolts 35 are received in the respectively associated through holes 34 with their heads 36 projecting above the through holes 34 to provide a space 37 between the lower frame horizontal portion 33 and the bolt heads 36 and springs 38 are wound about the shanks of the bolts 35 in the space 37. Reference numeral 39 denotes a flange formed about each of the bolts 35 in an intermediate point between the opposite ends of the bolt shank and reference numeral 40 denotes threads on the shank of the bolt 35. Positioned below the lower frame 31 is a ring-shaped resistance member 41 which includes a ring-shaped horizontal portion 42 positioned below and in paralled to the lower frame horizontal portion 33, a vertically slidable hollow cylindrical member 43 adapted to slide along the periphery of the lower frame vertical portion 32, a resistance portion 51 provided with a tapered face 44 facing and spaced from the tapered portion 28 at the lower end of the dish-shaped member 50 and a downwardly flared projection 47. The dish-shaped member tapered portion 28 and the tapered face 44 on the resistance member tapered resistance portion 51 define therebetween a discharge passage X which gradually reduces its thickness towards the lower end. Reference numeral 52 denotes a discharge chute and reference numeral 10 denotes a cavity defined between the upper framework 2 and polishing cylinder 24.

With the above-mentioned construction and arrangement of the components of the abrasive roll rice polishing machine of the invention, in operation, assuming that the supply passage 18 is closed and the abrasive roll 25 is rotating, when the lever 24' is manually lowered to raise the regulator valve 23 so as to open the supply passage 18, material or hulled rice grains are allowed to flow down from the hopper 6 through the supply passage 18 and supply port 14 into the polishing chamber 49 to fill the chamber with the hulled rice grains and the thus supplied rice grains are polished by the rotating abrasive roll 25 within the polishing chamber 49. In this embodiment, when the opening of the supply passage 18 is initially set larger than that of the discharge passage X, the polishing chamber 49 tends to be filled with the hulled rice grains to the degree that the chamber is clogged with the grains to thereby gradually increase the load applied to the polishing chamber 49 until an excessive load is applied to the polishing chamber to cause the polishing cylinder 24 to rotate together with the abrasive roll 25 against the force of the springs 22. When the polishing cylinder 24 rotates together with the abrasive roll 25, since the polishing cylinder 24 is hung from a plurality of inclined rods 20 as more clearly shown in FIG. 4, the polishing cylinder 24 moves downwardly as the cylinder rotates whereupon the resistance member 41 attached to the lower end of the polishing cylinder 24 also moves downwardly to thereby increase the volume of the discharge passage X defined by the opposing tapered portion 28 and tapered resistance face 44 whereby the opening of the discharge passage X becomes greater than that of the supply passage 18 resulting in decrease of the load applied to the polishing chamber 49.

The opening of the supply passage 18 can be adjusted depending upon the degree of the downward movement of the manual lever 24' which in turn varies depending upon the type of hulled rice grains to be polished in the machine. When the so-called "short rice grains" having a configuration Similar to a true circle are to be polished in the machine, the opening of the supply passage 18 may be maintained wide because the possibility of generation of crushed rice grains is less even if the hulled rice grains are continuously fed in a large amount. On the other hand, when very elongated hulled rice grains which are called as long rice grains are to be polished in the machine, if such rice grains are continuously fed in a large amount, the rice grains break down into crushed rice grains and thus, such rice grains have to be fed little by little.

Figure 7:
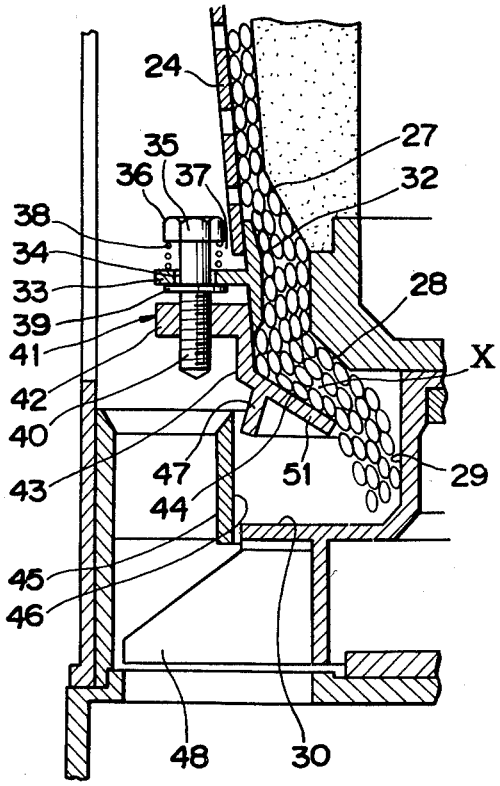
FIG. 7 is a fragmentary sectional view on an enlarged scale of the discharge passage of said rice polishing machine as shown in FIGS. 4, 5 and 6 showing the passage in its contracted condition position.
Figure 8:
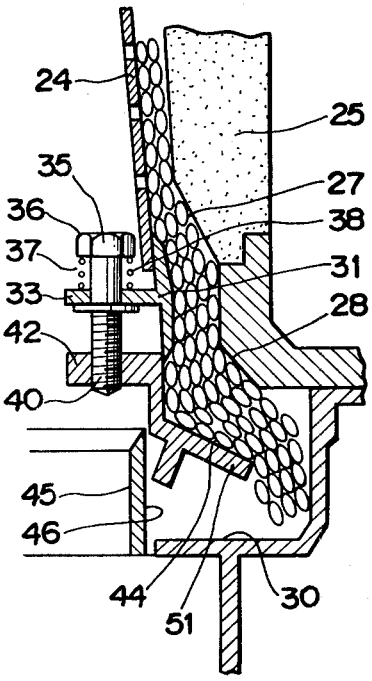
FIG. 8 is similar to FIG. 7, but shows the discharge passage in its expanded position.
Figure 9:
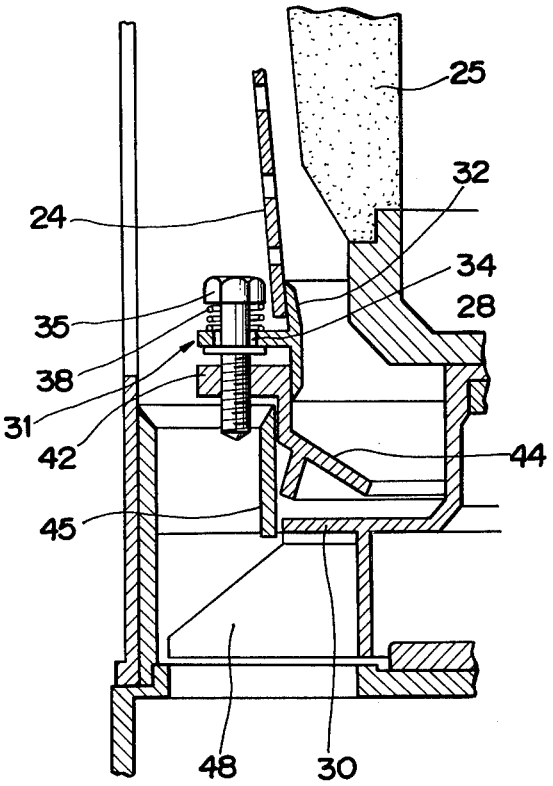
FIG. 9 is similar to FIG. 8, but shows the resitance member in its lowered position.
Figure 10:
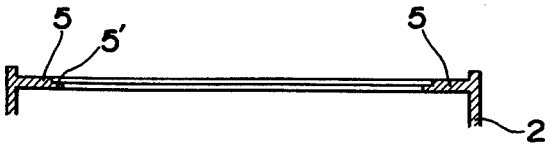
FIG. 10 is a fragmentary view on an enlarged scale of the stepped flange of said embodiment of the rice polishing machine.
Figure 11:
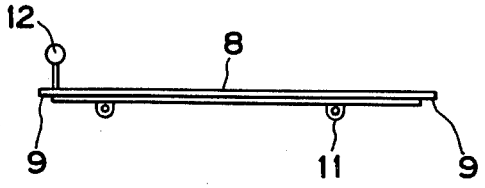
FIG. 11 is a fragmentary side view of the spring bearing ring of said embodiment of the rice polishing machine.

When the opening of the supply passage 18 is varied as hereinabove, the opening of the discharge passage X also has to be varied in accordance with the then opening of the supply passage. Variation in the opening of the discharge passage X is effected by turning the adjusting bolts 35. When the adjusting bolts 35 are tightned as shown in FIG. 7, the resistance member 41 bodily moves upwardly to substantially contract the opening of the discharge passage X and on the contrary, when the adjusting bolts 35 are loosened, the resistance member 41 bodily moves downwardly to expand the opening of the discharge passage X.

Figure 1:
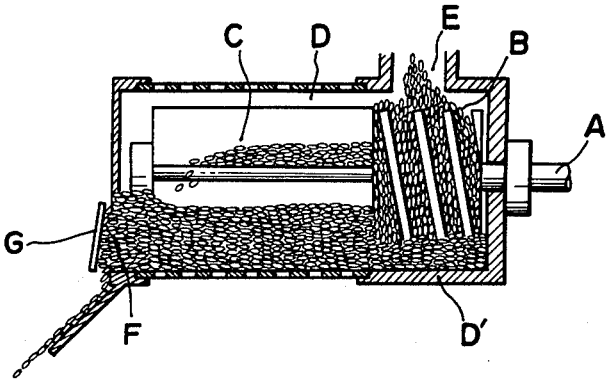
FIG. 1 PRIOR ART
FIG. 1 is a longitudinally sectional view of a prior art horizontal abrasive roll rice polishing machine.
Figure 2:
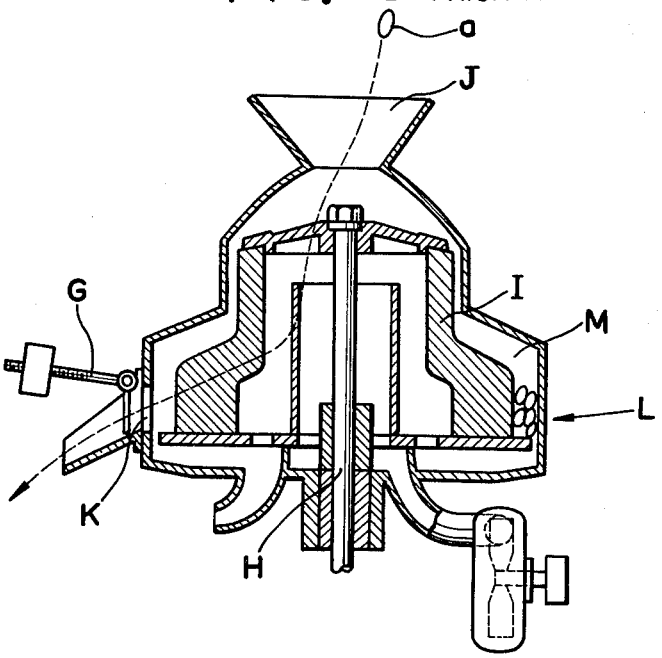
FIG. 2 PRIOR ART
FIG. 2 is a vertically sectional view of a prior art vertical abrasive roll rice polishing machine.
Figure 3:
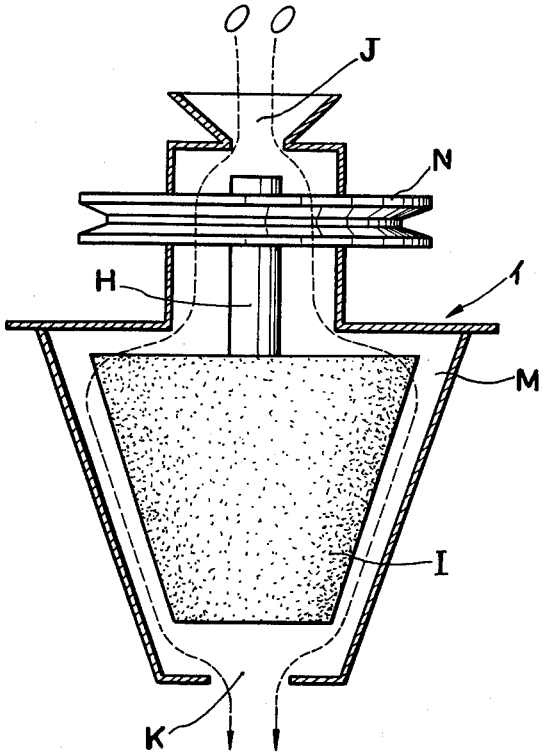
FIG. 3 PRIOR ART
FIG. 3 is a vertically sectional view of another prior art vertical abrasive roll rice polishing machine.

The polished rice grains passing through the discharge passage X and along the outer periphery of the rotating vertical cylinder 29 fall onto the flange-like guide face 30 which is rotating together with the vertical cylinder 29 to be guided to and into the dischage chute 52. In connection with the arrangement, it is to be noted that any cover is not provided for the resistance member 41 to thereby save the expense for the cover associated with the resistance member and that the discharge of polished rice grains can be smoothly carried out. In the conventional rice polishing machine as shown in FIG. 2, the resistance cover G is provided and in the conventional rice polishing machine as shown in FIG. 3, the resistance cover is provided under the discharge port K. However, such resistance cover is eliminated in the rice polishing machine of the present invention as mentioned hereinabove. That is, in the rice polishing machine of the present invention the components defining the discharge passage concurrently serve as the resistance cover.

In the rice polishing machine of the present invention, since both the tapered portion 28 and resistance face 44 which cooperate with each other in defining the discharge passage X are formed of metal, they ensure smooth discharge of polished rice grains. If the discharge passage X is not formed in the shoulder 27, for example, since the shoulder 27 presents a rough surface such as emery, smooth flow of polished rice grains is substantially impeded and thus, when the discharge passage X is adjusted to the contracted position, the passage will be clogged up with the rice grains. However, according to the present invention, the components defining the discharge passage present slippery faces to the polished rice grains and thus, the possibility of clogging up of the passage is eliminated. Even when the discharge passage is adjusted to a substantially contracted position, the rice grains can smoothly flow along the discharge passage without clogging up the passage provided that any space to allow the rice grains to pass through is left therein.

Having reached the rotating guide face 30, the polished rice grains are guided to the discharge chute 52 by the rotational movement of the guide face 30 to be discharged through the chute out of the machine. This guiding fuction is seemingly the same as that in the rice polishing machine as shown in FIG. 2. However, from the point of technical angle, the guided function in the present invention is quite different from that in the machine of FIG. 2. That is, in the rice polishing machine of FIG. 2, the rice grains accumulating at the area shown by the arrow L are the lowermost ones of a mass of rice grains closely packed in the rice polishing chamber M. In this closely packed condition of rice grains, even if a guide face which rotates in a horizontal plane is provided, such rice grains can not be guided to the discharge Port K. Furthermore, to consider the arrangement of the discharge port K in the rice polishing machine of FIG. 2, since the resistance cover G is pivoted to the discharge port K, the rice grains tend to clog up the machine at the area shown by the arrow L. On the contrary, in the rice polishing machine of the present invention, since the guide face 30 is constructed to carry the polished rice grains falling onto the narrow discharge passage X, the rice grains which fall down discretely but not are compacted are guided to the discharge chute. This arrangement is quite differrent from that in the rice polishing machine of FIG. 2.

According to the present invention, when the manual handle 12 is manually rotated in one or the other direction to rotate the spring bearing ring 8 in the one or the other direction the tension of the springs 22 is adjusted. When the tension of the springs 22 is increased, since the polishing cylinder 24 will not rotate even under a high load condition, the rice polishing efficiency is enhanced and when the tension of the springs 22 is reduced, since the polishing cylinder 24 rotates easily to enlarge the discharge passage X, rice polishing is carried out under a low load condition.

As clear from the foregoing description on the preferred embodiment of the present invention, the rice polishing can be performed while maintaining a maximum yield by adjusting the opening of the supply and discharge passages 18, X and the tension of the springs 22.

It will be understood that various changes in the details, materials and arrangements of parts which have been herein described and illustrated in order to explain the nature of the invention, may be made by those skilled in the art within the principle and scope of the invention.

What is claimed is:

1. A vertical abrasive roll rice polishing machine comprising a vertical cylindrical framework assembly, a vertical rotary shaft extending within said framework assembly in coaxial relation therewith and rotatably journaled therein, a vertically movable polishing cylinder mounted in said framework assembly in peripherally spaced and coaxial relationship to the framework assembly and surrounding said shaft in peripherally spaced relationship thereto, a vertical abrasive roll mounted on said shaft for rotation therewith within said polishing cylinder in peripherally spaced relation thereto to define an annular polishing chamber therebetween, transmission means mounted at the lower end of said shaft and drivingly connected to an external drive source to impart rotation to said shaft, a hopper at the top of said framework for feeding rice through an opening therein to said polishing chamber, and cooperating means on said polishing cylinder and said abrasive roll, respectively, defining a variable discharge passage for polished rice at the bottom of said polishing chamber.

2. The vertical abrasive roll rice polishing machine as set forth in claim 1, in which said vertically movable polishing cylinder is suspended from spring means which are anchored at the opposite ends, respectively to the top of the movable cylinder and to the top of said framework assembly.

3. The vertical abrasive roll rice polishing machine as set forth in claim 1, in which said means defining said variable discharge passage comprises a downwardly tapered face formed on the lower edge of a dish-shaped member provided at the lower end of said abrasive roll, and a confronting, tapered resistance face formed on a resistance member positioned below and spaced from the lower edge of said member.

4. The vertical abrasive roll rice polishing machine as set forth in claim 3, in which said resistance member is connected to a support on the lower end of said polishing cylinder by means of spring loaded adjusting bolts extending through said resistance member and said support, whereby the volume of said discharge passage may be varied by turning said adjusting bolts.

5. The vertical abrasive roll rice polishing machine as set forth in claim 1, including a regulator valve mounted in the hopper, and a lever pivotally connected to said regulator valve and operable to move said valve to vary the effective size of said opening in the hopper.

* * * * *